US010895375B2

(12) United States Patent
Zhou

(10) Patent No.: US 10,895,375 B2
(45) Date of Patent: Jan. 19, 2021

(54) LED HEAT DISSIPATION STRUCTURE, LED LAMP, AND HEAT DISSIPATION METHOD THEREOF

(71) Applicant: ZHEJIANG LI SHENG PHOTOELECTRIC TECHNOLOGY CO., LTD., Zhejiang (CN)

(72) Inventor: Yizhi Zhou, Zhejiang (CN)

(73) Assignee: ZHEJIANG LI SHENG PHOTOELECTRIC TECHNOLOGY CO., LTD., Zhejiang (CN)

( * ) Notice: Subject to any disclaimer, the term of this patent is extended or adjusted under 35 U.S.C. 154(b) by 28 days.

(21) Appl. No.: 16/461,804

(22) PCT Filed: Nov. 21, 2016

(86) PCT No.: PCT/CN2016/106555

§ 371 (c)(1),
(2) Date: May 17, 2019

(87) PCT Pub. No.: WO2018/090357

PCT Pub. Date: May 24, 2018

(65) Prior Publication Data

US 2020/0256553 A1 Aug. 13, 2020

(51) Int. Cl.

| | |
|---|---|
| ***F21V 29/67*** | (2015.01) |
| ***F21K 9/232*** | (2016.01) |
| ***F21V 31/03*** | (2006.01) |
| *F21Y 115/10* | (2016.01) |

(52) U.S. Cl.
CPC ..... *F21V 29/677* (2015.01); *F21K 9/232* (2016.08); *F21V 31/03* (2013.01); *F21Y 2115/10* (2016.08)

(58) Field of Classification Search
CPC ..... F21V 29/677; F21V 31/03; F21K 9/232; F21Y 2115/10
See application file for complete search history.

(56) References Cited

U.S. PATENT DOCUMENTS 10,731,839 B2 * 8/2020 Jiang ..... F21K 9/235
10,731,840 B2 * 8/2020 Jiang ..... F21K 9/235
(Continued)

FOREIGN PATENT DOCUMENTS

CN 101865370 10/2010
CN 102588789 7/2012
(Continued)

OTHER PUBLICATIONS

CN102588789A, Jul. 2012, machine translation (Year: 2012).*
(Continued)

*Primary Examiner* — Tracie Y Green
(74) *Attorney, Agent, or Firm* — JCIP Global Inc.

(57) ABSTRACT

An LED heat dissipation structure includes a heat sink, a cover plate, and an air blowing device. The heat sink has fins. Gaps between the fins form a plurality of continuous air flow channels, and air discharge ends of the air flow channels (16) extend to a peripheral surface of the heat sink. The cover plate covers the fins, closes openings of the airflow channels at tip portions of the fins, and partially bulges and forms an air inlet chamber communicating with the air flow channels. The air blowing device forcibly blows air into the air inlet chamber.

28 Claims, 10 Drawing Sheets

(56) References Cited

U.S. PATENT DOCUMENTS

| | | | | |
|---|---|---|---|---|
| 2009/0323361 | A1* | 12/2009 | Liu | F21V 29/74 362/373 |
| 2015/0345718 | A1* | 12/2015 | Okamoto | F21S 4/28 362/217.17 |
| 2016/0305640 | A1 | 10/2016 | Brown et al. | |
| 2018/0119938 | A1* | 5/2018 | Giffen | F21V 29/71 |

FOREIGN PATENT DOCUMENTS

| | | |
|---|---|---|
| CN | 203036318 | 7/2013 |
| CN | 203810342 | 9/2014 |
| CN | 206222019 | 6/2017 |

OTHER PUBLICATIONS

CN203036318U, Jul. 2013, machine translation (Year: 2013).*
CN203810342U, Mar. 2014, machine translation (Year: 2014).*
"International Search Report (Form PCT/ISA/210)", dated Jul. 27, 2017, with English translation thereof, pp. 1-6.

* cited by examiner

LED HEAT DISSIPATION STRUCTURE, LED LAMP, AND HEAT DISSIPATION METHOD THEREOF

CROSS-REFERENCE TO RELATED APPLICATION

This is a 371 application of the International PCT application serial no. PCT/CN2016/106555 filed on Nov. 21, 2016. The entirety of the above-mentioned patent application is hereby incorporated by reference herein and made a part of this specification.

BACKGROUND OF THE INVENTION

1. Field of the Invention

The present invention relates to the field of LED illumination technologies, and in particular, to an LED heat dissipation structure with a good heat dissipation effect, an LED lamp containing the same, and a heat dissipation method of the LED lamp.

2. Description of Related Art

LED lamps have the advantages of being energy-saving, environmentally friendly and the like, but emit heat in a working process, especially high-power LED lamps, because the heat emitting amount thereof is relatively great. The heat cannot be dissipated timely even if a heat sink is adopted. Therefore, the application of the LED lamps is limited. In order to improve the heat dissipation effect, in existing design, a back surface of the heat sink is provided with a fan, accelerating air convection is thus accelerated, and the heat dissipation effect is improved.

As disclosed in Chinese Patent No. CN102588789A, a high-power LED energy-saving lamp with a fan is formed by a lamp housing, a substrate, a lamp bead, heat-dissipating fins, a fan and a driving power, wherein the substrate, the lamp bead, the cooling fins, the fan and the driving power are installed in the lamp housing. The heat-dissipating fins are fixed on the substrate, the fan is installed on the heat-dissipating fins, an air inlet hole and an air outlet hole are formed in the lamp housing, and air flow is accelerated by rotation of the fan, so that high-efficiency heat dissipation of the LED energy-saving lamp is realized. Because the fan is directly aligned to the fins, the formed air is omnidirectional. Due to the blocking of the fins, cooling air cannot reach the bottoms of the fins, while the bottoms are the regions with the highest temperature. The air flow rate attenuates and the air can be counteracted due to baffling, resulting in low air flow rate at areas far away from the fan, and finally causing poor overall heat dissipation effect.

SUMMARY OF THE INVENTION

The present invention provides an LED heat dissipation structure improving a heat dissipation effect by forcibly blowing air.

An LED heat dissipation structure, including:

a heat sink including fins, where gaps between the fins form a plurality of continuous air flow channels, and air discharge ends of the air flow channels extend to a peripheral surface of the heat sink;

a cover plate, which covers the fins, closes opening of the air flow channels at tip portions of the fins, and partially bulges and forms an air inlet chamber communicating with the air flow channels; and an air blowing device, which forcibly blowing air into the air inlet chamber.

Because a gap exists between adjacent fins, the gaps are interwoven and connected to form the air flow channels, and thus is favorable for air flow. Because the fins are generally vertically arranged, the flow channels are provided with openings at the tip portions of the fins.

The cover plate covers a back surface of the heat sink, and openings at upper sides of the air flow channels are closed. Then air is forcibly blown into the air inlet chamber, cold air will enter the air flow channels instead of being directly discharged from the openings at the upper sides, and can reach the bottoms of the fins, so as to realize sufficient heat exchange. In addition, hot air is discharged from a side surface of the heat sink and is capable of performing heat exchange with all the fins, so that the heat dissipation efficiency is improved.

It is certain that if the cover plate does not completely cover all the fins, the hot air may also be discharged from the openings that are not closed. Although the heat dissipation effect is not optimal, it is improved to a certain extent. Because the air flow channels are relatively narrow, while the air inlet chamber is relatively large, when air is blown into the air inlet chamber, a certain pressure is formed in the air inlet chamber, and therefore, forcible air blowing is needed.

Preferably, the cover plate extends to a peripheral edge of the heat sink and covers all the fins, so that the heat sink only discharges air in a side direction, and heat exchange between the air and all the fins is ensured.

Preferably, the air inlet chamber is divided into a plurality of independent sub-chambers, and each sub-chamber is provided with 1-2 air blowing devices.

Preferably, the air flow channels linearly extend to the peripheral surface of the heat sink from a position of the air inlet chamber, so as to reduce the air resistance and improve the flow rate.

The heat sink may be set according to the actual requirement of a lamp, and it may be of a round shape, a square shape, a rectangular shape, an oval shape or an irregular shape.

Preferably, a cross section of the heat sink is a circle, the air inlet chamber is located at a center position of the heat sink, and the fins are distributed in a radial form.

Preferably, a back surface of the heat sink is divided into a plurality of fan-shaped heat dissipation regions, and a clapboard is provided between adjacent heat dissipation regions, so as to avoid air cross counteraction.

Preferably, the air inlet chamber is divided into a plurality of independent sub-chambers, and the sub-chambers and the heat dissipation regions are arranged in one-to-one correspondence.

Preferably, a pit in a downward inverted cone shape is formed at a center of a bulging portion bulging to form the air inlet chamber, such that the air inlet chamber is of an annular structure, and the air blowing device surrounds the bulging portion. The air inlet chamber is of an annular structure, so as to avoid interference of air delivered by corresponding air blowing devices.

More preferably, an opening is formed in a bottom of the pit to form an independent vent pipe, and a center of the heat sink is provided with a through hole joined to the vent pipe, so as to realize heat dissipation for the substrate and the LED lamp bead.

Preferably, the heat sink is provided with multiple groups of the fins surrounding a center line of the heat sink. The farther the fins are away from the center line, the more the quantity of the fins is. And the fins of adjacent groups are in staggered arrangement, so that the air flow channels distributed in a tree form are formed, and the heat dissipation effect is improved.

In another preferable manner, a cross section of the heat sink is of a square shape, the air inlet chamber is strip-shaped and stretches across whole of the heat sink, and the fins are perpendicular to the air inlet chamber.

A first clapboard which divides the heat sink into two equal portions is provided at a center of the heat sink, the air inlet chamber is provided at a center position of the heat sink, a second clapboard joined with the first clapboard is provided in the air inlet chamber and divides the air inlet chamber into two equal portions in the same way, and each of the two portions is provided with a set of the air blowing device.

A first clapboard which divides the heat sink into two equal portions is provided at a center of the heat sink, a number of the air inlet chamber is two, the two air inlet chambers are symmetrically provided at two sides of the first clapboard, and each air inlet chamber is provided with a set of the air blowing device.

The two foregoing manners are capable of shortening a distance of the air flow channels, so as to reduce the resistance of air flow and improve the heat dissipation effect.

Preferably, baffles are provided at two sides of the heat sink, the two sides are parallel to the fins, so as to prevent air from leaking from a side surface.

Preferably, the air blowing device is an axial flow fan or a turbofan, and is more preferably a turbofan. The turbofan is capable of providing higher pressure for the air inlet chamber.

Preferably, a bulging portion forming the air inlet chamber is provided with an opening for installing the air blowing device, and the air blowing device is adhered into or engaged with the opening in a fixed way by a sealant.

The cover plate is provided with a driving power of the air blowing device.

The present invention also provides an LED lamp including the LED heat dissipation structure. The heat sink is provided with a substrate with a back to the fins and a lens providing a focusing function, an LED lamp bead is provided on the substrate, a cover casing for protecting the air blowing device and circuits in the lamp is installed on the cover plate, an air inlet is formed in a side surface of the cover casing, and a lamp head is provided at the tail portion of the cover casing.

Preferably, the cover casing is formed by an upper casing and a lower casing, a bottom of the lower casing is fixedly connected with the cover plate, an opening is formed in a top portion of the lower casing, the lower casing radially shrinks to extend into the upper casing, a gap between the upper casing and the lower casing forms the air inlet, and the lamp head is provided at a top portion of the upper casing, and such design is capable of preventing water from entering the casing, especially for lamps with the application environment being a water area, such as a fish attracting lamp, etc.

More preferably, a water retaining structure is provided in the gap.

The following structure may be adopted: the water retaining structure includes a first water retaining ring provided at an outer side surface of the lower casing and a second water retaining ring provided at an inner side surface of the upper casing, the first water retaining ring is transversely provided and extends to an inner side wall of the upper casing, and the second water retaining ring is in longitudinal arrangement and surrounds the upper casing.

The first water retaining ring inclines downwards.

Preferably, the upper casing is connected with the lower casing by a connecting rod, so as to improve the air inlet smoothness.

Preferably, a groove matched with the substrate is formed in a surface of the heat sink mounting substrate, and a notch for discharging air are formed at a peripheral edge of the groove, so as to be convenient for discharging hot air.

With the same reason, air discharge hole is formed in a matching position of the heat sink and the lens.

In order to be waterproof, two stages of step structures are formed at the edges matched by the heat sink, the step structure at an inner side and the step structure at an outer side are respectively provided with a first notch and a second notch which are provided in a staggered manner, and a communicating slot connecting the first notch with the second notch is formed in the heat sink.

The prevent invention also provides a heat dissipation method of the LED lamp, including a heat sink with fins, where gaps between the fins form a plurality of through air flow channels, air discharge ends of the air flow channels extend to a peripheral surface of the heat sink; a back surface of the heat sink is provided with an air inlet chamber which covers the fins, closes openings of the air flow channels at the tip portions of the fins, and partially bulges and forms an air inlet chamber communicating with the air flow channel; and the heat dissipation method includes following steps: forcibly blowing air into the air inlet chamber, such that heat exchange between the air and the fins is performed and then the air is discharged from a side surface of the heat sink.

Preferably, an air pressure in the air inlet chamber is kept to be higher than a barometric pressure by 100-200 pa.

The cover plate covers the fins, openings of the air flow channels at the tip portions of the fins are closed, the air inlet chamber is provided locally at the center of the cover plate, and cooling air is forcibly blown into the air flow channels by the air blowing devices, so as to increase the heat exchange. Thus, the requirements of high-power LED lamps are met.

DESCRIPTION OF THE EMBODIMENTS

Figure 1:
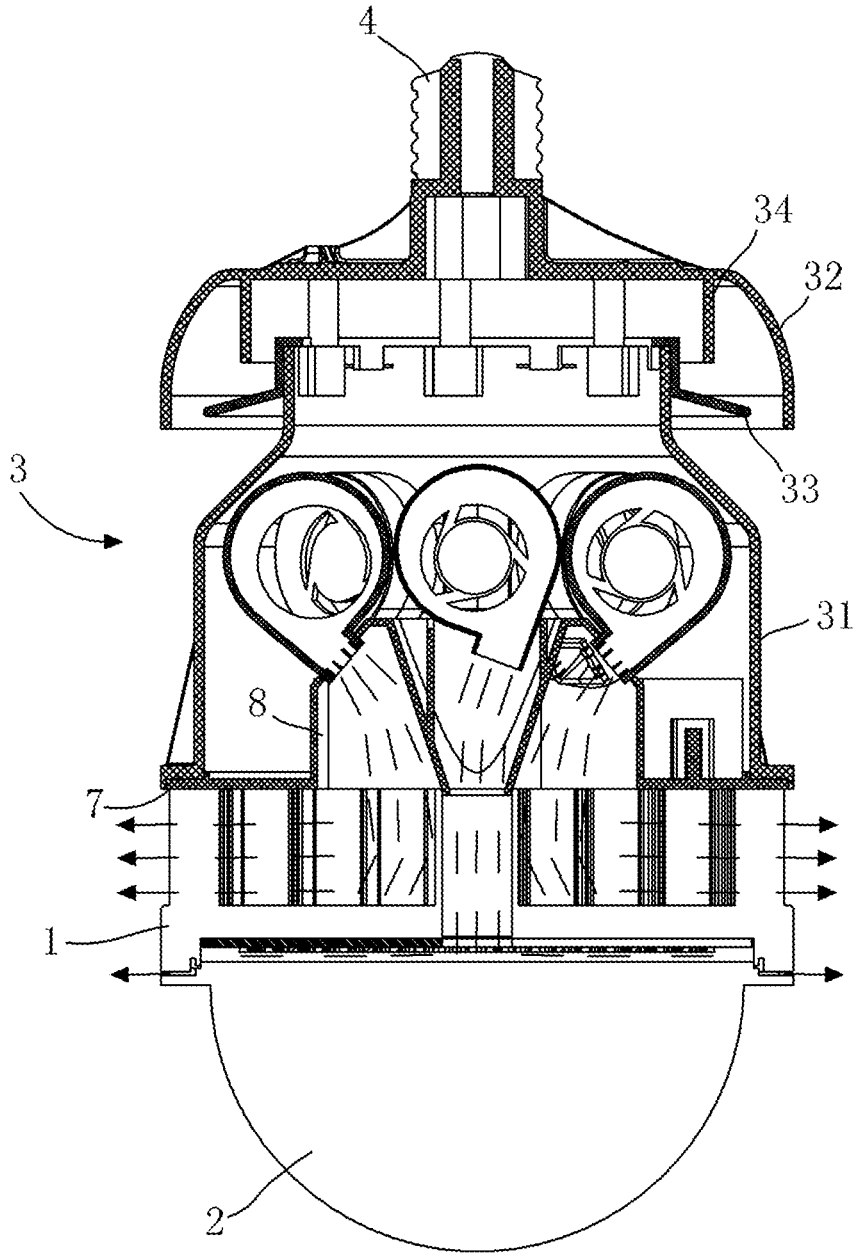
FIG. 1 is a schematic structural diagram of an LED lamp according to the present invention.
Figure 2:
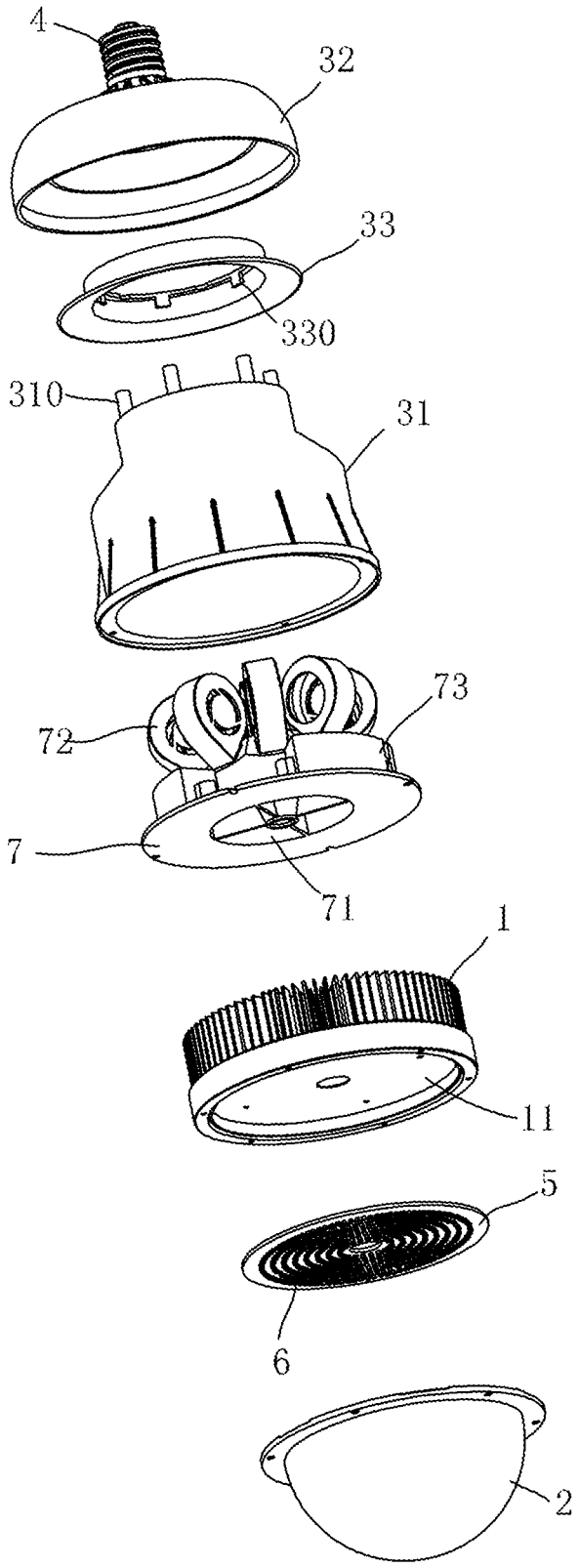
FIG. 2 is an explosion schematic structural diagram of the LED lamp according to the present invention.

As shown in FIG. 1 and FIG. 2, an LED lamp includes a heat sink 1 made from materials such as aluminum alloy. A substrate 5 and a lens 2 are installed on a front surface of the heat sink 1. A plurality of LED lamp beads 6 are distributed on the substrate 5, and the lens 2 is mainly used to provide a focusing function, and matches with the heat sink 1 to package the substrate 5 and the LED lamp beads 6 in a relatively sealed cavity. The substrate may be made from materials such as aluminum and copper, and a driving module may be distributed on the substrate, to be used for converting alternating current into direct current.

Figure 5:
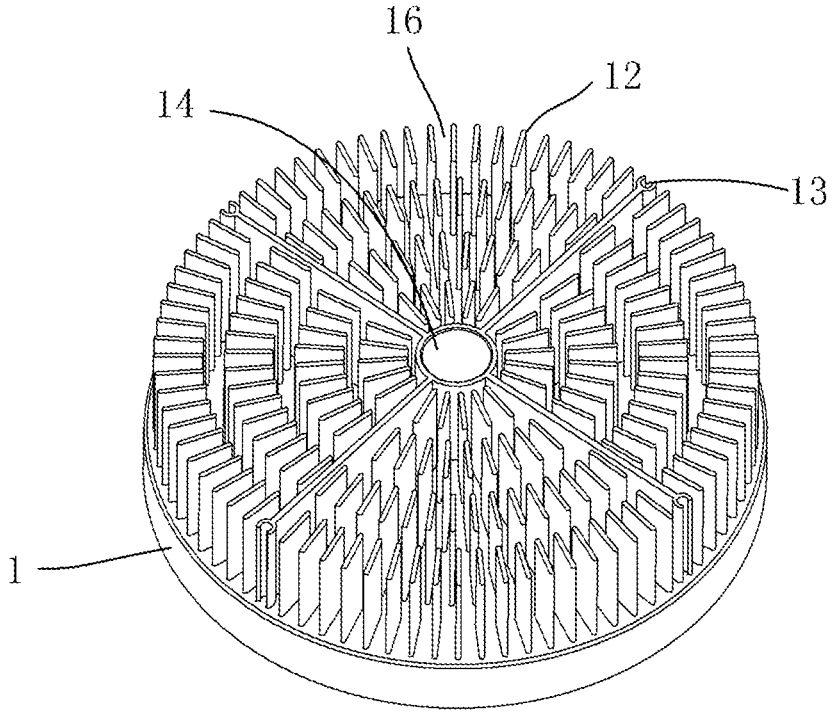
FIG. 5 is a schematic structural diagram of a heat sink according to the present invention.

As shown in FIG. 5, a back surface of the heat sink 1 is provided with fins 12, the fins 12 are vertically provided, gaps are formed between every two fins 12, and the gaps are connected and interwoven together to form continuous air flow channels 16. The heat sink shown in FIG. 5 is a circle, it is certain that the heat sink may be of other shapes, such as a square shape, an oval shape or an irregular shape, but the distribution of the fins 12 needs to meet the condition that air discharge ends of the air flow channels 16 extend to a peripheral surface of the heat sink 1, so as to ensure that air in the air flow channels is discharged from a side surface of the heat sink after heat exchange.

According to the heat sink shown in FIG. 5, the fins 12 are distributed in a radial form, that is, the fins 12 are distributed along a radial direction of the heat sink 1. The fins 12 are divided into a plurality of groups, each group of the fins are distributed around a center of the heat sink. The farther the fins are away from the heat sink, the more the quantity of the fins is. And the fins of adjacent groups are in staggered arrangement, so that the air flow channels 16 are distributed in a tree form, and the heat dissipation area is maximized. The back surface of the heat sink 1 is also divided into a plurality of fan-shaped heat dissipation regions, and a clapboard 13 is provided between adjacent heat dissipation regions, so that air flows out towards one direction basically, and the phenomenon of flow rate attenuation caused by excessive baffling is avoided. A screw hole for fixing the cover plate 7 is formed at a tail end of the clapboard 13.

Figure 3:
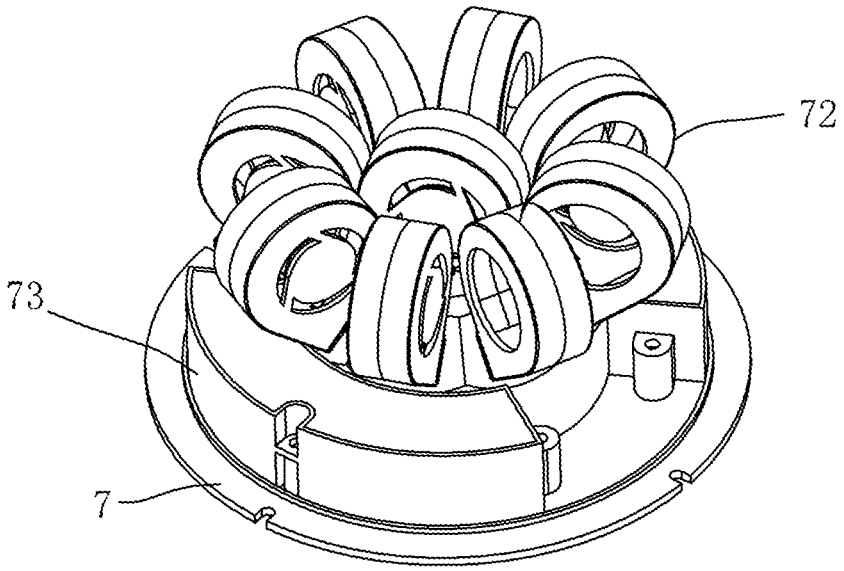
FIG. 3 is a partial schematic structural diagram of a cover plate of the LED lamp shown in FIG. 1.
Figure 4:
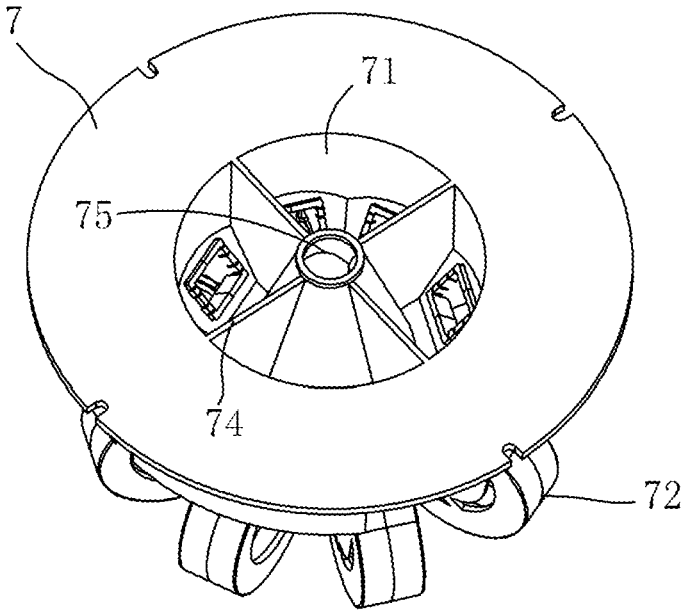
FIG. 4 is a schematic structural diagram of the cover plate from another angle shown in FIG. 3.

As shown in FIG. 1 and FIG. 2, the back surface of the heat sink 1 is provided with a cover plate 7 adhered to the fins 12, the cover plate 7 basically covers all the fins, and closes openings of the air flow channels at tip portions of the fins, so as to ensure that air is discharged from the side surface of the heat sink. As shown in FIG. 3 and FIG. 4, a middle of the cover plate 7 bulges and forms an air inlet chamber 71, and because the cover plate bulges, the openings of the air flow channels below are not closed, so that all the air flow channels communicate with the air inlet chamber 71. An opening is formed in the bulging portion, and a turbofan 72 is fixed on the bulging portion by an adhesive or a buckling structure. The turbofan 72 may also be replaced by an axial flow fan. But the volume of the axial flow fan is relatively large, and a pressure of the delivered air is relatively low, so return air may also occur under the condition of relatively low power.

As shown in FIG. 1, the turbofans 72 surround the bulging portion, and an air discharge pipe extends into the air inlet chamber 71. A center of the bulging portion sinks downwards and extends to the fins 12. The air inlet chamber is of an annular structure, so that air discharge of the oppositely provided turbofans 72 may not counteract due to interference, and the condition that a certain pressure exists in the air inlet chamber is ensured. In addition, the turbofans 72 are obliquely provided, and air is blown towards a pit in the center and enters the air flow channels after baffling. It is the best that the bulging portion and the cover plate are integrated by stamping, or by adopting an assembling manner.

As shown in FIG. 4, in order to avoid mutual interference of air discharge of the turbofans 72, and a clapboard 74 is provided in the air inlet chamber 71 to divide the air inlet chamber 71 into a plurality of sub-chambers. Each sub-chamber in this embodiment is provided with two turbofans, and the sub-chambers and the heat dissipation regions at the back surface of the heat sink 1 are also in one-to-one correspondence, that is to say, air discharge of two turbofans corresponds to one heat dissipation region. In order to improve the heat dissipation effect, a through hole is formed in a bottom of the pit, an independent ventilating duct 75 is formed, a joining through hole 14 is formed in the center of the corresponding heat sink, and the turbofan 72 is installed at a top of the pit, so that the cold air is forcibly blown into a space where the substrate 5 is located.

Figure 6:
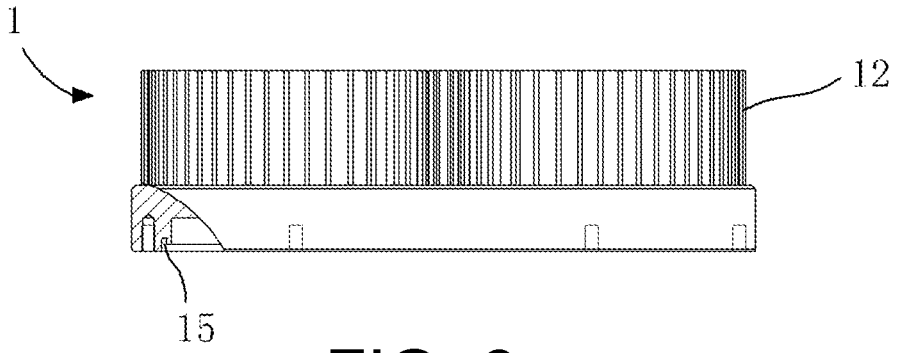
FIG. 6 is a partial cross-sectional view of the heat sink according to the present invention.
Figure 7:
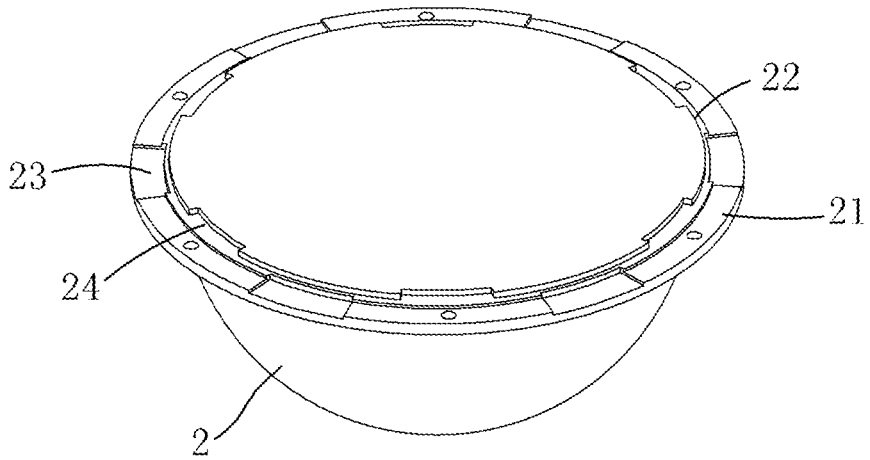
FIG. 7 is a schematic structural diagram of a lens according to the present invention.
Figure 8:
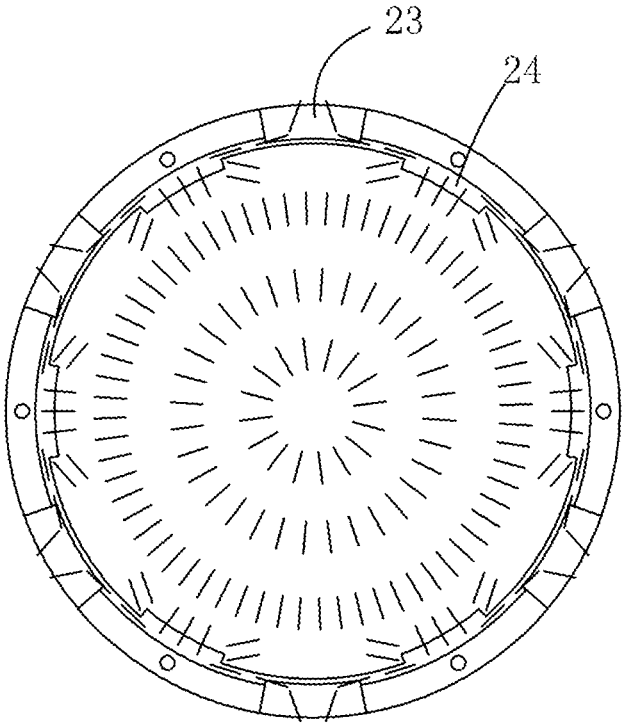
FIG. 8 is an air discharge schematic diagram of the lens according to the present invention.

As shown in FIG. 2, in order to smoothly discharge air for cooling the substrate 5 and the LED lamp beads 6, a groove 11 is formed in a surface of the heat sink 1 mounting the substrate 5. A notch (not shown in the drawing) for discharging air is formed in an edge of the groove, but such structure is not waterproof. A waterproof air discharge mechanism is provided at a matching edge of the lens and the heat sink. As shown in FIG. 7, an edge of the lens 2 is provided with two stages of step structures 21, 22, a notch 23 and a notch 24 are respectively formed in the step structures at an inner side and an outer side, and the notch 23 and the notch 24 are provided in a staggered manner. As shown in FIG. 6, a communicating slot 15 communicating the notches 23 and 24 is formed in the corresponding position of the heat sink 1. An air discharge path between the lens 2 and the heat sink 1 is as shown in FIG. 8 (the dotted line in the drawing is the gas flow direction), and because multiple bends exist in an edge region of the air path, water is effectively prevented from entering a lamp body.

As shown in FIG. 1 and FIG. 2, in order to protect circuits in the lamp and the turbofans, a back surface of the cover plate 7 is provided with a cover casing 3. The cover casing includes two parts, namely, a lower casing 31 and an upper casing 32. The upper casing 32 is of a lampshade shape with a top portion being provided with a lamp head 4, two ends of the lower casing 31 are open, one end is connected with the cover plate, the other end radially shrinks and extends into the upper casing 32, and the upper casing 32 and the lower casing are connected by a connecting rod 310, so that the cavity of the cover casing 3 may be communicated with outside.

A gap exists between the upper casing 32 and the lower casing 31, the gap is an air inlet hole, and in order to prevent water and the like from entering the casing, a water retaining mechanism is provided in the gap. The water retaining mechanism includes water retaining rings 33 and 34. The water retaining ring 33 is provided at an outer side surface of the lower casing 31, and inclines to extend towards the upper casing 32. The water retaining ring 34 is provided at an inner side surface of the upper casing 32, vertically extends towards the lower casing 31, surrounds the connecting rod 310, and is joined with the lower casing 31. It is certain that the water retaining mechanism may also adopt other existing structures.

Figure 10:
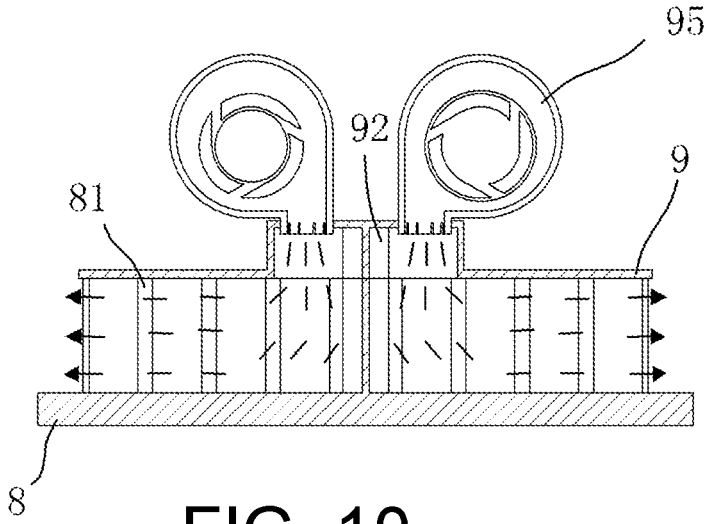
FIG. 10 is an air discharge schematic diagram of the heat dissipation structure shown in FIG. 9.
Figure 14:
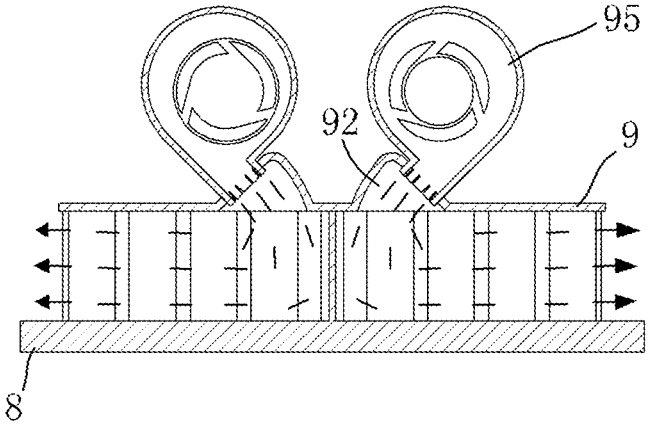
FIG. 14 is an air discharge schematic diagram of the heat dissipation structure shown in FIG. 13.
Figure 15:
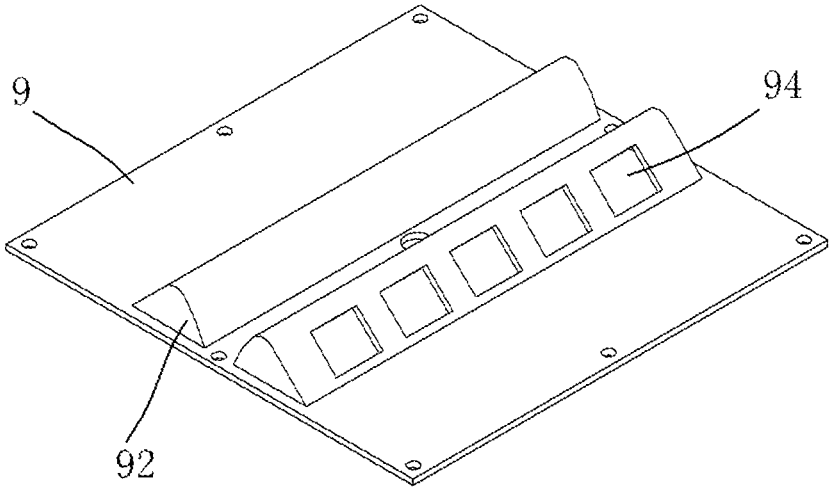
FIG. 15 is a schematic structural diagram of the cover plate in the heat dissipation structure shown in FIG. 13.
Figure 16:
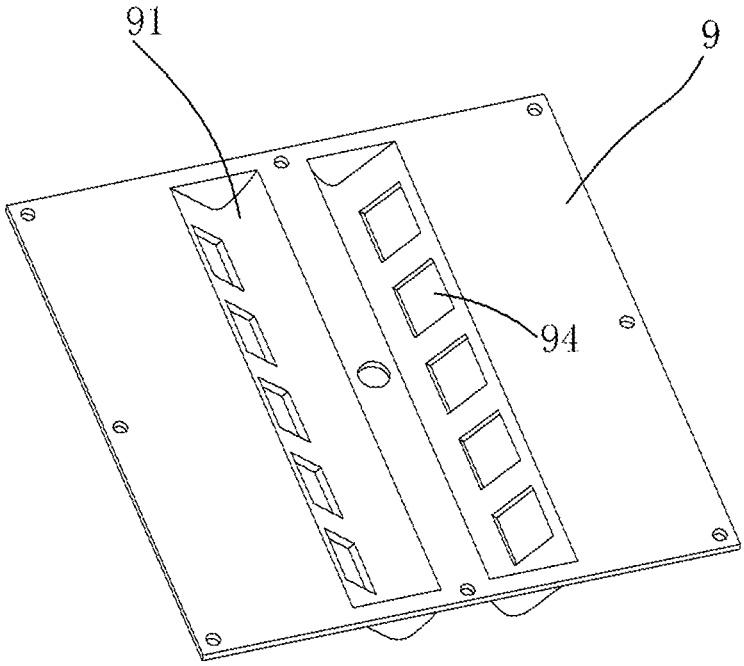
FIG. 16 is a schematic structural diagram of the cover plate from another angle shown in FIG. 15.

The heat sink of the LED lamp is of a circle structure, and as mentioned above, the heat sink may also be square. FIG. 10 and FIG. 14 disclose a square LED heat dissipation structure, including a square heat sink 8, a back surface of the heat sink is similarly provided with fins 81, the fins are divided into multiple groups and are provided in parallel, and the gaps between the fins form a plurality of air flow channels 84 which are parallel to one another.

Figure 9:
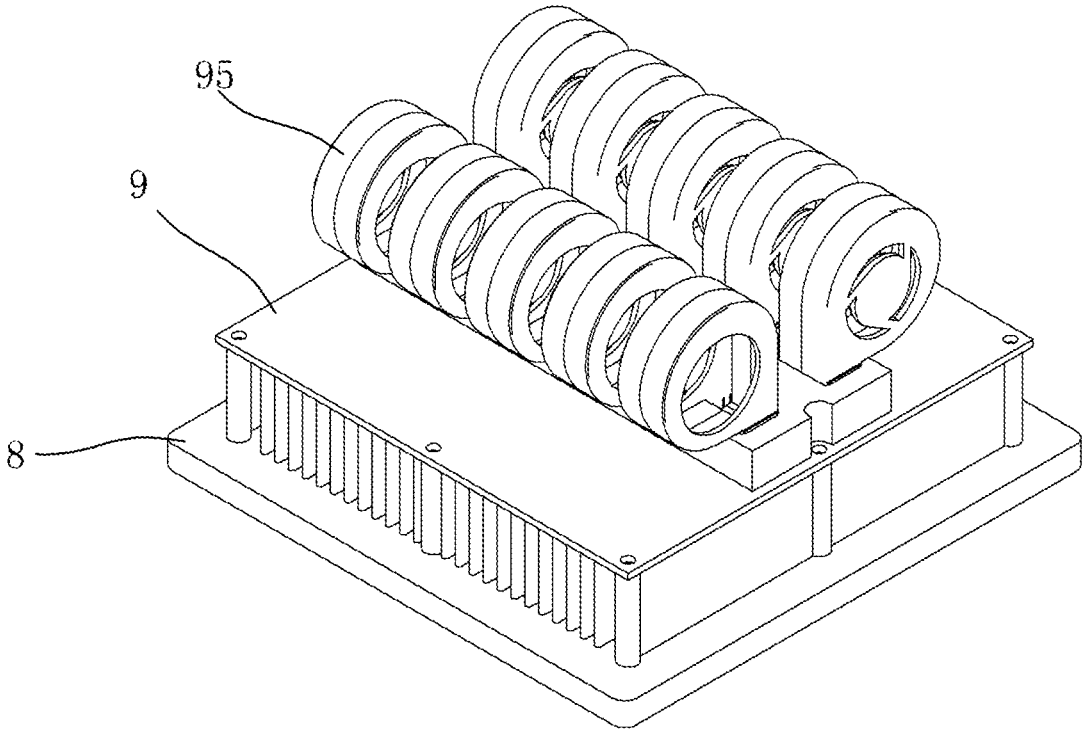
FIG. 9 is a schematic diagram of an LED heat dissipation structure according to the present invention.
Figure 17:
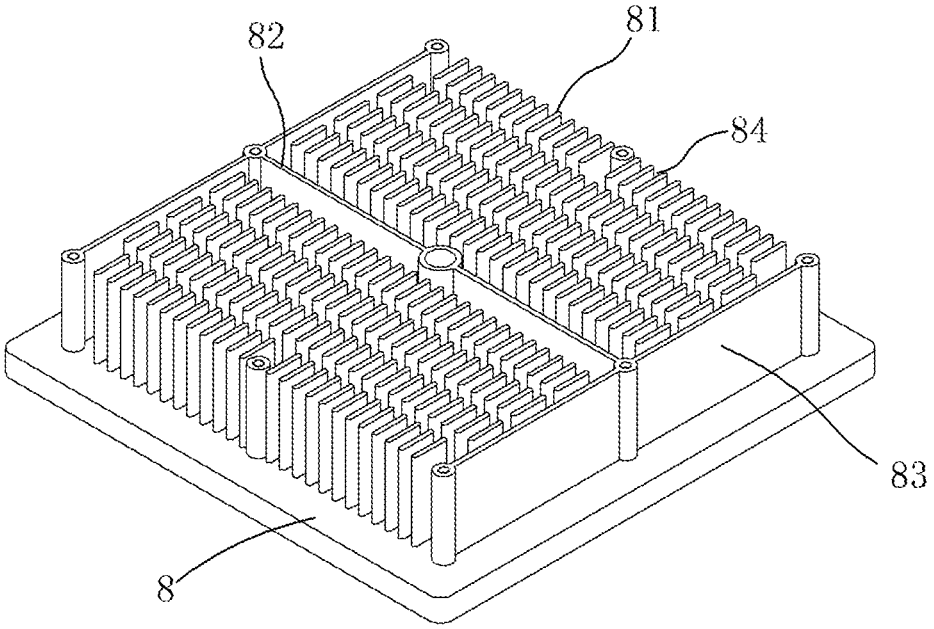
FIG. 17 is a schematic structural diagram of the square heat sink according to the present invention.

As shown in FIG. 17, the heat sink 8 not only is provided with baffles 83 at two sides, but also is provided with a clapboard 82 at the center, and the heat dissipation region is divided into two parts, in order to reduce a length of the air flow channels 84, reduce the resistance and improve the air flow rate. As shown in FIG. 9 and FIG. 10, the cover plate 9 completely covers the back surface of the heat sink 1 and closes openings of the air flow channels 84 at the tip portions of the fins 81, and the air flow channels 84 only have openings at the side surface of the heat sink.

Figure 11:
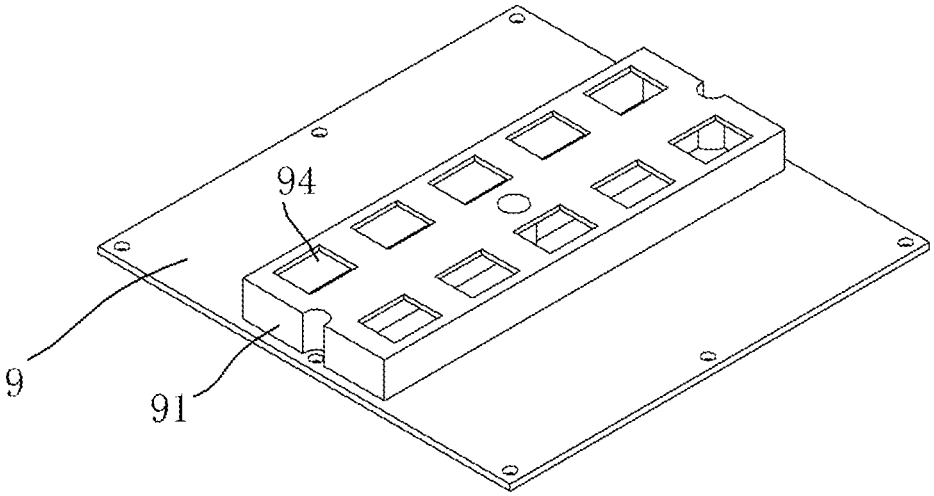
FIG. 11 is a schematic structural diagram of the cover plate in the heat dissipation structure shown in FIG. 9.
Figure 12:
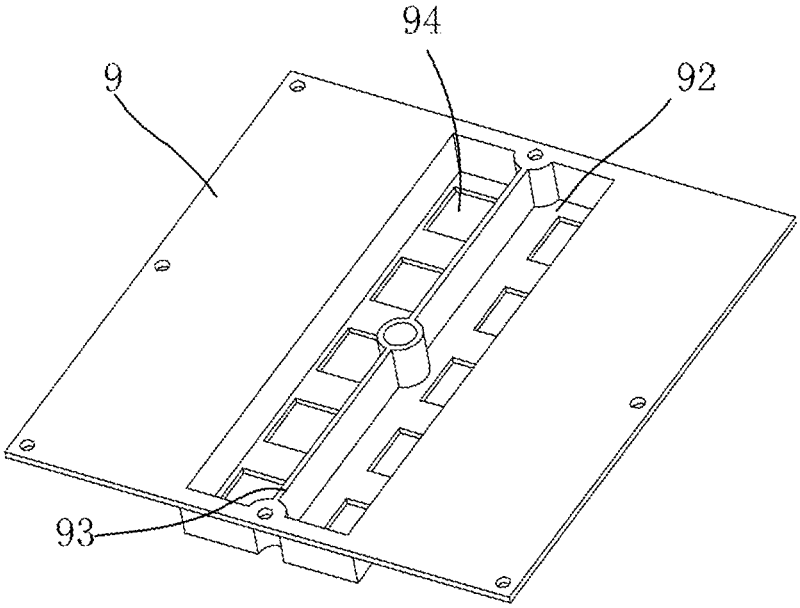
FIG. 12 is a schematic structural diagram of the cover plate from another angle shown in FIG. 11.
Figure 13:
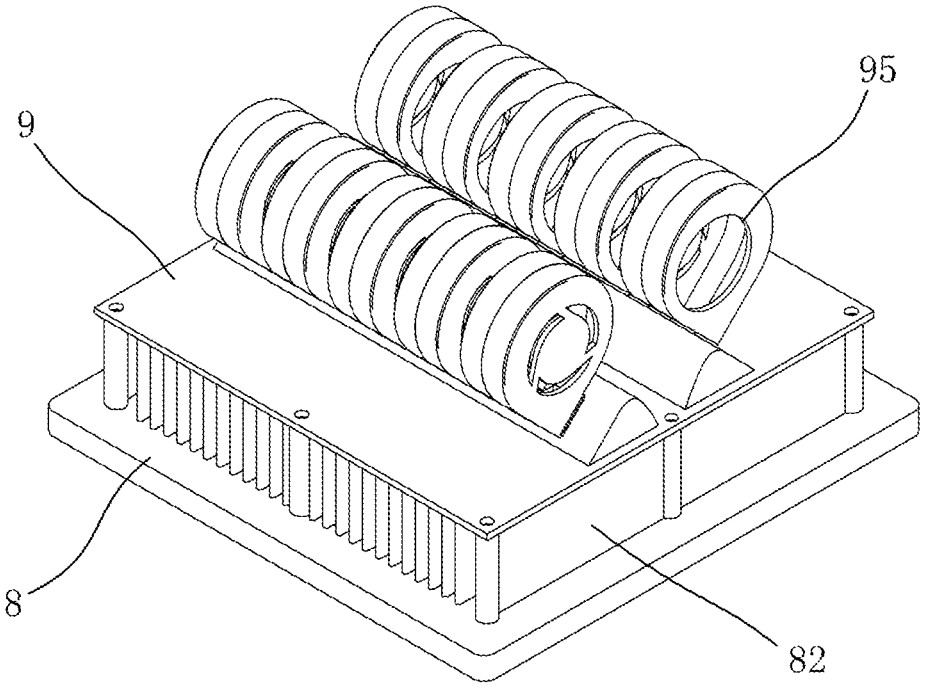
FIG. 13 is a schematic diagram of another square LED heat dissipation structure according to the present invention.

As shown in FIG. 11 to FIG. 12, a bulging portion 91 is formed at a center of the cover plate 9, so as to form an air inlet chamber 92 communicating with the air flow channels 84, and the bulging portion 91 is strip-shaped and stretches across the heat dissipation fins 81. An opening 94 is formed in the bulging portion 91 to be used for installing turbofans 95. Because the heat dissipation region of the heat sink 1 is divided into two parts, and a clapboard 93 is also provided in the air inlet chamber 92 to divide the air inlet chamber 92 into two corresponding parts, and the two parts are respectively provided with a set of turbofans 95.

As shown in FIG. 13 to FIG. 16, another LED heat dissipation structure is provided. The heat sink 1 of such structure is also as shown in FIG. 7, the difference lies in the shape of the cover plate, specifically, the arrangement manner of the bulging portion. The cover plate 9 is provided with two bulging portions 91, to form two air inlet chambers 92. The two air inlet chambers 92 are provided at two sides of the clapboard 82, and are respectively corresponding to two heat dissipation regions of the heat sink 1, and each air inlet chamber 92 is provided with one set of turbofans 95, and the turbofans 95 are obliquely provided.

It may be seen that the fins at the back surface of the heat sink are completely covered by the cover plate, resulting in the situation that openings of the air flow channels at the tip portions of the fins are closed, so as to prevent air from flowing out from the openings. And all air is discharged from the openings at the side surfaces of the fins, so that the heat exchange between the air and most of the fins is performed. In addition, air is introduced in a concentrated way from the air inlet chamber, so as to avoid influence of the outside environment to the air speed, and meanwhile, the problem of too fast air bowing pressure attenuation is overcome. Finally, the turbofan is adopted to forcibly blow air, the resistance of the fins is overcome, a certain air flow rate is ensured, heat exchange is accelerated, heat exchange efficiency and area are increased comprehensively, and the heat dissipation effect is greatly improved.

As mentioned above, the fins have certain resistance against air, and therefore, the air inlet chamber needs pressure, which is generally higher than a barometric pressure by 100-200 pa. It is certain that the pressure may be changed according to the change of the air flow channels. A rotating speed of the fan is generally controlled to be equal to or greater than 3,000 rev.

What is claimed is:

1. An LED heat dissipation structure, comprising:

a heat sink, including fins, wherein gaps between the fins form a plurality of continuous air flow channels, and air discharge ends of the air flow channels extend to a peripheral surface of the heat sink;

a cover plate, covering the fins, closing openings of the air flow channels at tip portions of the fins, and partially bulging and forming an air inlet chamber communicating with the air flow channels; and at least one air blowing device, forcibly blowing air into the air inlet chamber, wherein the air inlet chamber is divided into a plurality of independent sub-chambers, and each sub-chamber is provided with 1 to 2 of the air blowing devices.

2. The LED heat dissipation structure according to claim 1, wherein the cover plate extends to a peripheral edge of the heat sink and covers all the fins.

3. The LED heat dissipation structure according to claim 1, wherein the air flow channels linearly extend to the peripheral surface of the heat sink from a position of the air inlet chamber.

4. The LED heat dissipation structure according to claim 1, wherein a cross section of the heat sink is a circle, the air inlet chamber is located at a center position of the heat sink, and the fins are distributed in a radial form.

5. The LED heat dissipation structure according to claim 4, wherein a back of the heat sink is divided into a plurality of fan-shaped heat dissipation regions, and a clapboard is provided between adjacent heat dissipation regions.

6. The LED heat dissipation structure according to claim 5, wherein the sub-chambers and the heat dissipation regions are arranged in one-to-one correspondence.

7. The LED heat dissipation structure according to claim 4, wherein a pit in downward inverted cone shape is formed at a center of a bulging portion bulging to form the air inlet chamber, such that the air inlet chamber is of an annular structure, and the air blowing device surrounds the bulging portion.

8. The LED heat dissipation structure according to claim 7, wherein an opening is formed in a bottom of the pit to form an independent vent pipe, and a center of the heat sink is provided with a through hole joined to the vent pipe.

9. The LED heat dissipation structure according to claim 4, wherein the heat sink is provided with multiple groups of the fins surrounding a center line of the heat sink, the farther the fins are away from the center line, the more the quantity of the fins is, and the fins of adjacent groups are in staggered arrangement.

10. The LED heat dissipation structure according to claim 1, wherein a cross section of the heat sink is of a square shape, the air inlet chamber is strip-shaped and stretches across whole of the heat sink, and the fins are perpendicular to the air inlet chamber.

11. The LED heat dissipation structure according to claim 10, wherein a first clapboard which divides the heat sink into two equal portions is provided at a center of the heat sink, the air inlet chamber is provided at a center position of the heat sink, a second clapboard joined with the first clapboard is provided in the air inlet chamber and divides the air inlet chamber into two equal portions, and each portion is provided with a set of the air blowing device.

12. The LED heat dissipation structure according to claim 10, wherein a first clapboard which divides the heat sink into two equal portions is provided at a center of the heat sink, a number of the air inlet chamber is two, the two air inlet chambers are symmetrically provided at two sides of the first clapboard, and each air inlet chamber is provided with a set of the air blowing device.

13. The LED heat dissipation structure according to claim 10, wherein baffles are provided at two sides of the heat sink, the two sides are parallel to the fins.

14. The LED heat dissipation structure according to claim 1, wherein the air blowing device is an axial flow fan or a turbofan.

15. The LED heat dissipation structure according to claim 14, wherein a bulging portion forming the air inlet chamber is provided with an opening for installing the air blowing device, and the air blowing device is adhered into or engaged with the opening in a fixed way by a sealant.

16. The LED heat dissipation structure according to claim 14, wherein the cover plate is provided with a driving power of the air blowing device.

17. An LED lamp, comprising the LED heat dissipation structure according to claim 1, wherein the heat sink is provided with a substrate with a back to the fins and a lens providing a focusing function, an LED lamp bead is provided on the substrate, a cover casing for protecting the air blowing device and circuits in the lamp is installed on the cover plate, an air inlet is formed in a side surface of the cover casing, and a lamp head is provided at a tail portion of the cover casing.

18. The LED lamp according to claim 17, wherein the cover casing is formed by an upper casing and a lower casing, a bottom portion of the lower casing is fixedly connected with the cover plate, an opening is formed in a top portion of the lower casing, the lower casing radially shrinks to extend into the upper casing, a gap between the upper casing and the lower casing forms the air inlet, and the lamp head is provided at a top portion of the upper casing.

19. The LED lamp according to claim 18, wherein a water retaining structure is provided in the gap.

20. The LED lamp according to claim 19, wherein the water retaining structure comprises a first water retaining ring provided at an outer side surface of the lower casing and a second water retaining ring provided at an inner side surface of the upper casing, the first water retaining ring is transversely provided and extends to an inner side wall of the upper casing, and the second water retaining ring is in longitudinal arrangement and surrounds the upper casing.

21. The LED lamp according to claim 20, wherein the first water retaining ring inclines downwards.

22. The LED lamp according to claim 18, wherein t the upper casing is connected with the lower casing by a connecting rod.

23. The LED lamp according to claim 17, wherein a groove matched with the substrate is formed in a surface of the heat sink for mounting the substrate, and a notch for discharging air are formed at a peripheral edge of the groove.

24. The LED lamp according to claim 17, wherein an air discharge hole is formed in a matching position of the heat sink and the lens.

25. The LED lamp according to claim 24, wherein two stages of step structures are formed at the edges matched by the lens and the heat sink, the step structure at an inner side and the step structure at an outer side are respectively provided with a first notch and a second notch which are provided in a staggered manner, and a communicating slot connecting the first notch with the second notch is formed in the heat sink.

26. A heat dissipation method of the LED lamp, the LED lamp comprising a heat sink that includes fins, wherein gaps between the fins form a plurality of through air flow channels, air discharge ends of the air flow channels extend to a peripheral surface of the heat sink; a back surface of the heat sink is provided with a cover plate, which covers the fins, closes openings of the air flow channels at tip portions of the fins, and partially bulges and forms an air inlet chamber communicating with the air flow channels; the air inlet chamber is divided into a plurality of independent sub-chambers, and each sub-chamber is provided with 1 to 2 air blowing devices forcibly blowing air into the air inlet chamber, and the heat dissipation method comprises following steps: forcibly blowing air into the air inlet chamber by the air blowing devices, such that heat exchange between air and the fins is performed and then the air is discharged from a side surface of the heat sink.

27. The heat dissipation method according to claim 26, wherein an air pressure in the air inlet chamber is kept to be higher than a barometric pressure by 100 to 200 pa.

28. The heat dissipation method according to claim 26, wherein the air is forcibly blown by using an axial flow fan or a turbofan, and a rotating speed is higher than 3,000 rev/s.

* * * * *